US007882812B2

(12) United States Patent
Arinaga et al.

(10) Patent No.: US 7,882,812 B2
(45) Date of Patent: Feb. 8, 2011

(54) VALVETRAIN MECHANISM OF ENGINE

(75) Inventors: Tsuyoshi Arinaga, Yamato (JP); Shinichi Takemura, Yokohama (JP); Toru Fukami, Machida (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 364 days.

(21) Appl. No.: 12/184,619

(22) Filed: Aug. 1, 2008

(65) Prior Publication Data

US 2009/0038566 A1 Feb. 12, 2009

(30) Foreign Application Priority Data

Aug. 10, 2007 (JP) ..... 2007-209706

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.39, 90.44; 29/888.1, 888.2; 74/559, 74/567, 569
See application file for complete search history.

(56) References Cited

U.S. PATENT DOCUMENTS 7,246,578 B2 * 7/2007 Nakamura et al. ..... 123/90.16
2003/0226531 A1 12/2003 Miyazato et al.

FOREIGN PATENT DOCUMENTS

| | | |
|---|---|---|
| EP | 1 484 517 A2 | 12/2004 |
| FR | 2 853 001 | 10/2004 |
| GB | 2 410 061 A | 7/2005 |
| JP | 2002-38913 | 2/2002 |
| JP | 2005-113720 | 4/2005 |
| JP | 2007-162706 | 6/2007 |

* cited by examiner

*Primary Examiner*—Ching Chang
(74) *Attorney, Agent, or Firm*—Drinker Biddle & Reath LLP

(57) ABSTRACT

A valvetrain mechanism of an engine, including a drive shaft configured to rotate in synchronization with the engine, a link arm having a large end and a small end, the drive shaft being inserted into and passed through the large end, a valve lift control shaft disposed parallel to the drive shaft and having an eccentric portion, an oscillating arm disposed rotatably at the eccentric portion of the valve lift control shaft and interconnected with the small end of the link arm via a first rotation support point, a link rod interconnected with the oscillating arm via a second rotation support point positioned at a same side as the first rotation support point with respect to the valve lift control shaft, and an oscillating cam interconnected with the link rod via a third rotation support point and operated correspondingly with an operation of the drive shaft to thereby open a valve. A thickness of the small end of the link arm in a direction of the drive shaft is thinner than a thickness of the large end of the link arm in the direction of the drive shaft.

9 Claims, 12 Drawing Sheets

VALVETRAIN MECHANISM OF ENGINE

CROSS-REFERENCE TO RELATED APPLICATIONS

This application claims priority to Japanese Patent Application No. 2007-209706 filed Aug. 10, 2007, which is incorporated by reference herein in the entirety.

BACKGROUND OF THE INVENTION

1. Field of the Invention

The present invention relates to a valvetrain mechanism of an engine.

2. Description of Related Art

A conventional valvetrain mechanism includes a link arm and a link rod arranged at the same shaft. With such an arrangement, there is a concern that an oscillating arm may be leaned due to an input load from the link arm and the link rod.

Given the above concern, it is an object of the present invention to provide a valvetrain mechanism in which the oscillating arm is not leaned or leaned to a smaller degree than in the conventional valvetrain mechanism.

BRIEF SUMMARY OF THE INVENTION

In an embodiment, the invention provides a valvetrain mechanism of an engine, including a drive shaft configured to rotate in synchronization with the engine, a link arm having a large end and a small end, the drive shaft being inserted into and passed through the large end, a valve lift control shaft disposed parallel to the drive shaft and having an eccentric portion, an oscillating arm disposed rotatably at the eccentric portion of the valve lift control shaft and interconnected with the small end of the link arm via a first rotation support point, a link rod interconnected with the oscillating arm via a second rotation support point positioned at a same side as the first rotation support point with respect to the valve lift control shaft, and an oscillating cam interconnected with the link rod via a third rotation support point and operated correspondingly with an operation of the drive shaft to thereby open a valve. A thickness of the small end of the link arm in a direction of the drive shaft is thinner than a thickness of the large end of the link arm in the direction of the drive shaft.

According to the present invention, the small end of the link arm is formed to have a smaller thickness than the large end. As such, it is possible to shorten a distance between the loads inputted in the oscillating arm so that a moment leaning the oscillating arm becomes smaller. Consequently, it is difficult to lean the oscillating arm and a compactness of the total mechanism is facilitated.

BRIEF DESCRIPTION OF THE DRAWINGS

The accompanying drawings, which are incorporated herein and constitute part of this specification, illustrate preferred embodiments of the invention, and together with the general description given above and the detailed description given below, serve to explain features of the invention.

DETAILED DESCRIPTION OF THE PREFERRED EMBODIMENTS

First Embodiment

Figure 1:
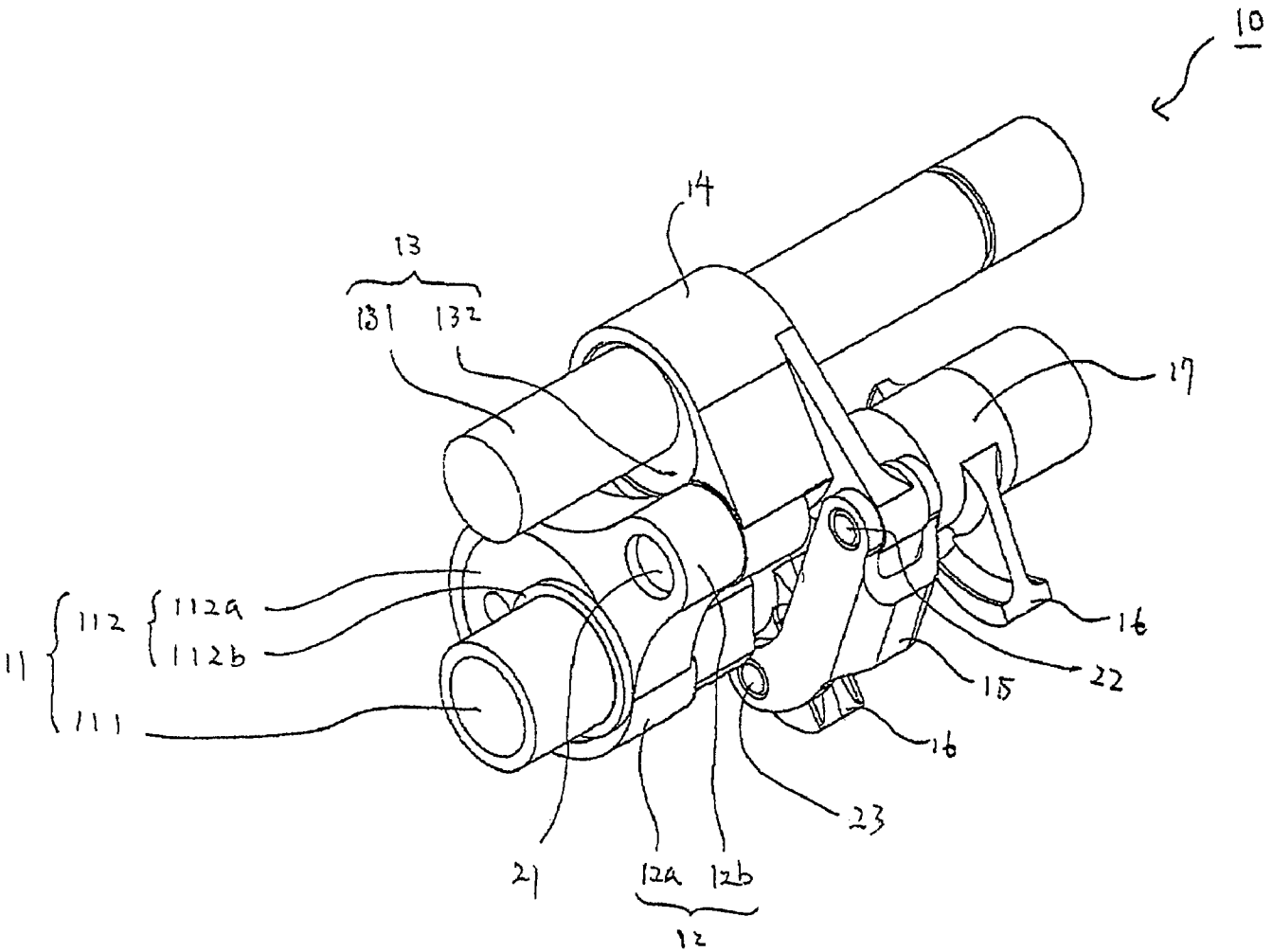
FIG. 1 is a perspective view showing a valvetrain mechanism of an engine in accordance with a first embodiment of the present invention.
Figure 2A:
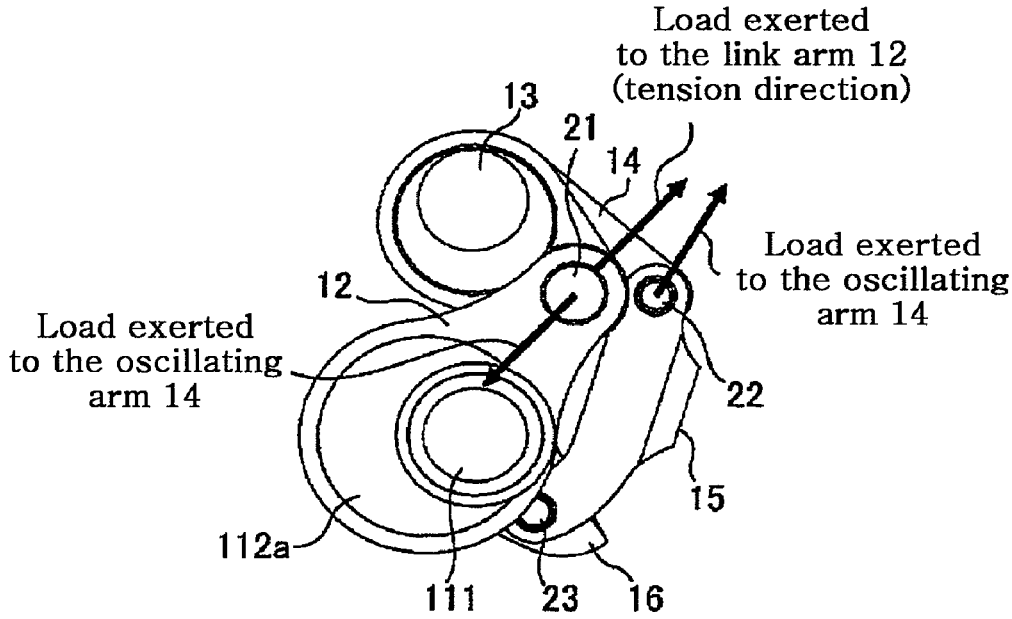
FIGS. 2A and 2B show a valvetrain mechanism in accordance with the first embodiment of the present invention.
Figure 2B:
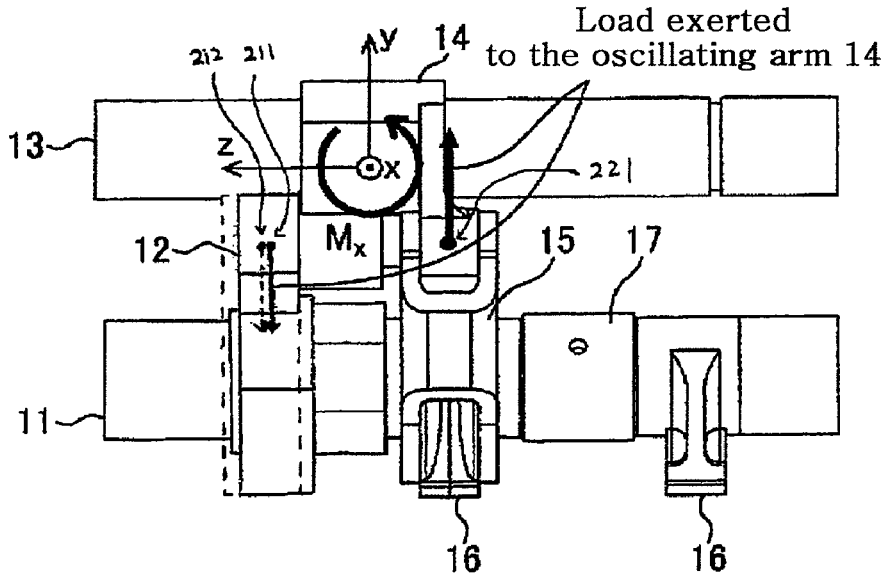

FIG. 1 is a perspective view illustrating a valvetrain mechanism of an engine in accordance with a first embodiment of the present invention. FIG. 2A is a left-side view thereof and FIG. 2B is a front view of the same.

A valvetrain mechanism 10 of the present invention includes a drive shaft 11, a link arm 12, a valve lift control shaft 13, an oscillating arm 14, a link rod 15 and an oscillating cam 16. The oscillating cam 16 is operated and oscillated correspondingly with the drive shaft 11, which rotates in synchronization with a rotation of the engine to thereby open/close the valve. The drive shaft 11 and the valve lift control shaft 13 are rotatably supported at a bearing (not shown).

The drive shaft 11 is rotatably supported at an upper portion of a cylinder head along a front-rear direction of the engine. A torque is transferred from a crankshaft of the engine to thereby rotate the drive shaft 11. The drive shaft 11 includes a drive shaft main body 111 and a drive cam 112. The drive shaft main body 111 has a hollow shape. The drive shaft 11 is formed of a high-strength material. The drive cam 112 is fastened to the drive shaft main body 111. The drive cam 112 is an eccentric rotation cam, which is biased from a shaft center of the drive shaft main body 111 toward one side. The drive cam 112 is rotated integrally with the drive shaft main body 111. The drive cam 112 is formed of an abrasion-resistant material. The drive cam 112 includes a cam body 112*a* and a boss portion 112*b*. The cam body 112*a* and the boss portion 112*b* are integrally formed. A shaft center of the cam body 112*a* is off-set by a predetermined amount from the shaft center of the drive shaft main body 111 along a diametrical direction. The drive cam 112 is connected and fastened to the drive shaft main body 111 by a connecting pin 20, as further described below.

The link arm 12 includes a large end 12*a* and a small end 12*b*. The drive cam 112 (cam body 112*a*) is inserted so as to be passed through the large end 12*a*. The small end 12*b* is connected to the oscillating arm 14 by a first rotation support point such as pin 21.

The valve lift control shaft 13 is arranged parallel to the drive shaft 11. The valve lift control shaft 13 includes a valve lift control shaft main body 131 and an eccentric cam (eccentric portion) 132. The eccentric cam 132 is an eccentric rotation cam, which is biased from a shaft center of the valve lift control shaft main body 131 toward one side. The eccentric cam 132 is rotated integrally with the valve lift control shaft main body 131. The valve lift control shaft 13 is controlled so as to be rotated within a predetermined range of rotation angle by an actuator (not shown). The actuator controls a rotation of the valve lift control shaft 13 based on the present driving state of the engine detected from detecting signals from various sensors such as a crank angle sensor, an air flow meter and a water temperature sensor, etc. If the rotation of the valve lift control shaft 13 is controlled, then a position of the eccentric cam 132, which is biased toward one side, is adjusted so that an oscillating center of the oscillating arm 14 is changed.

The oscillating arm 14 is operated and oscillated correspondingly with the rotation of the drive shaft 11. The valve lift control shaft 13 (eccentric cam 132) is inserted so as to be passed through the oscillating arm 14. As such, the oscillating arm 14 is rotatable with respect to the eccentric cam 132.

The link rod 15 connects the oscillating arm 14 and the oscillating cam 16. The link rod 15 has a cross-sectional "C" shape and couples relatively rotatable via a second rotation support point such as pin 22 by arranging a vicinity of a leading end of the oscillating arm 14 at an inner side of the link rod 15. The pin 22 is spaced apart from the shaft center of the eccentric cam 132 compared to the pin 21.

The oscillating cam 16 is a pair of members fixedly installed in a pipe 17. The pipe 17 is inserted so as to be passed through the drive shaft 11 to thereby be oscillate-able around the drive shaft 11. The oscillating cam 16 at one side is connected to be relatively rotatable to the link rod 15 by a third rotation support point such as pin 23. The oscillating cam 16 moves upwardly and downwardly to thereby open/close the valve.

Figure 3A:
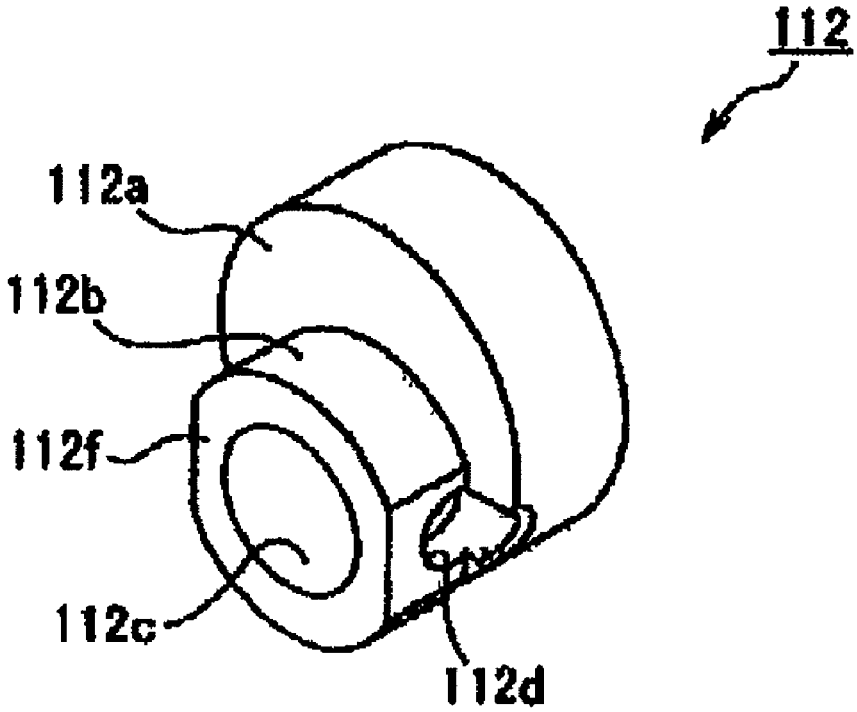
FIGS. 3A and 3D show a drive cam of the valvetrain mechanism in accordance with the first embodiment of the present invention.
Figure 3B:
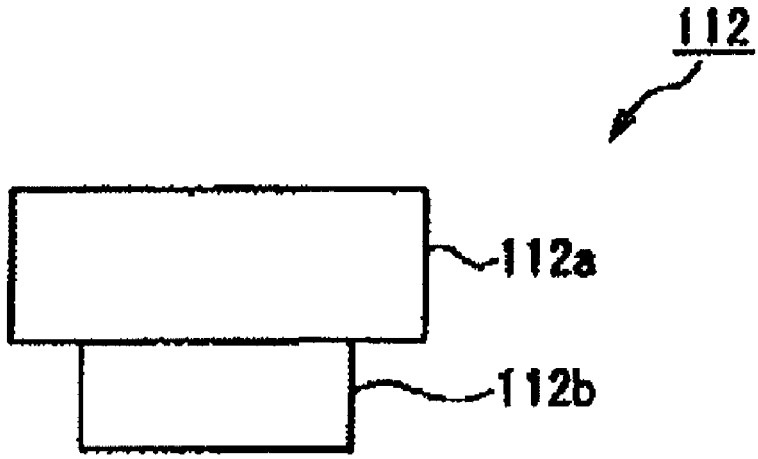
Figure 3C:
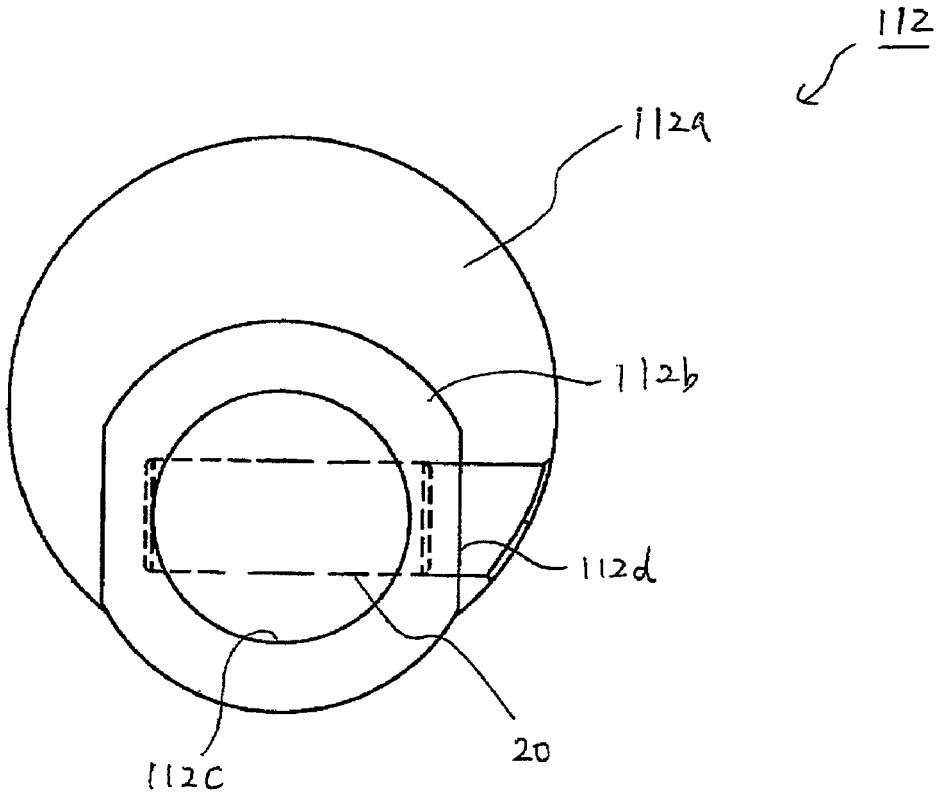
Figure 3D:
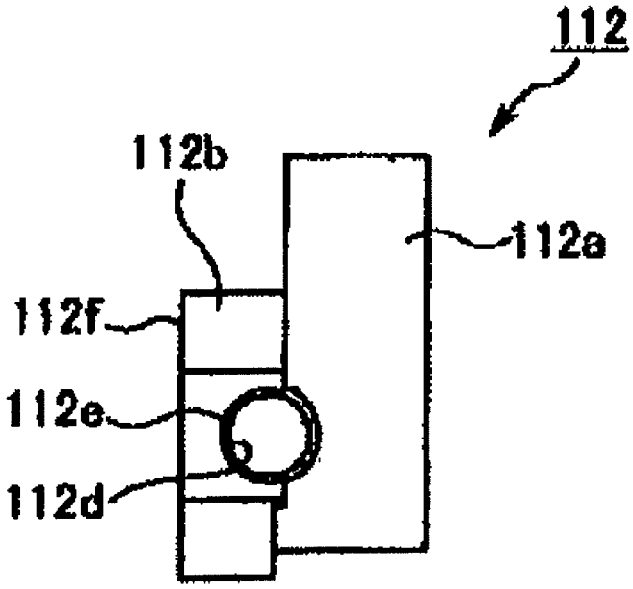

FIGS. 3A to 3D show the drive cam in accordance with the first embodiment of the present invention. Specifically, FIG. 3A is a perspective view, FIG. 3B is a plan view, FIG. 3C is a front view and FIG. 3D is right-side view.

The drive cam 112 includes the cam body 112*a* and the boss portion 112*b*. The cam body 112*a* and the boss portion 112*b* are integrally formed. A large hole 112*c* for inserting the drive shaft main body is formed in the drive cam 112. The shaft center of the cam body 112*a* is offset by a predetermined amount from a center of the large hole 112*c* along a diametrical direction. A small hole 12*d* is formed at a boundary of the cam body 112*a* and the boss portion 112*b*. The small hole 112*d* is formed through the cam body 112*a* and the boss portion 112*b*.

Further, the drive shaft main body 111 is inserted into the large hole 112*c* and the pin 20 (indicated by a dashed line in FIG. 3C) is pressed into the small hole 112*d*. A caulking area 112*e* prevents the pressing pin 20 from being released. Accordingly, the drive cam 112 is fixedly installed to the drive shaft main body 111.

As such, since the caulking area 112*e* is caulked, the pressing pin 20 is not released and the drive cam 112 is securely fastened to the drive shaft main body 111.

Further, the small hole 112*d* is formed at the boundary of the cam body 112*a* and the boss portion 112*b*. Specifically, it is formed through the cam body 112*a* and the boss portion 112*b*, and is spaced apart from an end surface 112*f* of the boss portion 112*b*. As such, its strength can be secured. Although the strength can be secured as the small hole 112*d* becomes spaced apart from the end surface 112*f*, the pressing pin 20 cannot be caulking-fastened when the entire small hole 112*d* is positioned at the cam body 112*a*. That is, since the link arm 12 slidably moves along an outer peripheral surface of the cam body 112*a*, if such a slide-moving surface is caulked, then a smoothness of the slide-moving surface is damaged.

However, since the small hole 112*d* is formed at the boundary of the cam body 112*a* and the boss portion 112*b* and through the cam body 112*a* and the boss portion 112*b*, the compatibility between the strength and the slide-moving performance can be enhanced.

Figure 4A:
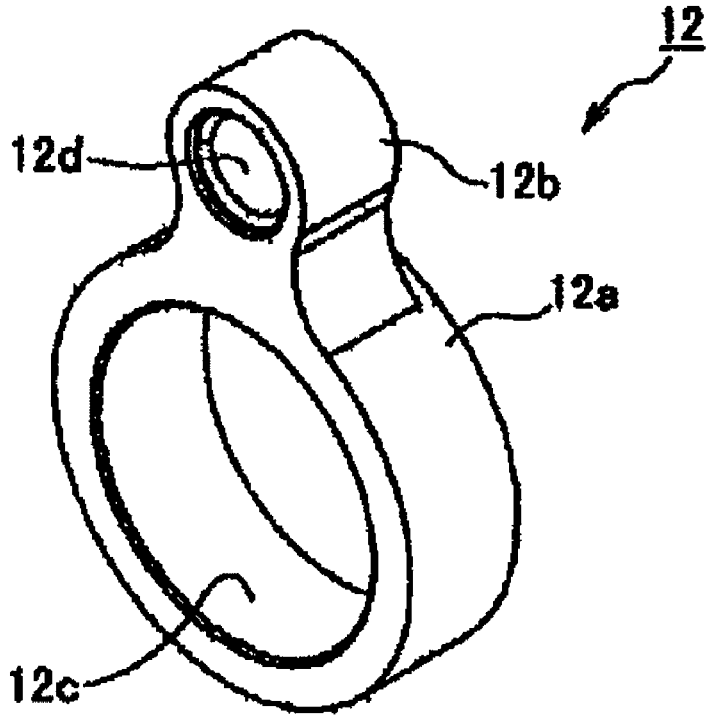
FIGS. 4A-4D show a link arm of the valvetrain mechanism in accordance with the first embodiment of the present invention.
Figure 4B:
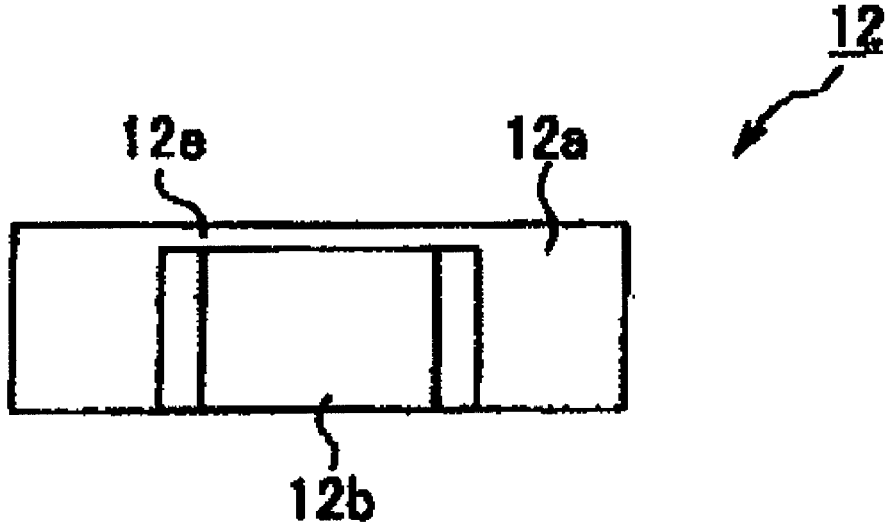
Figure 4C:
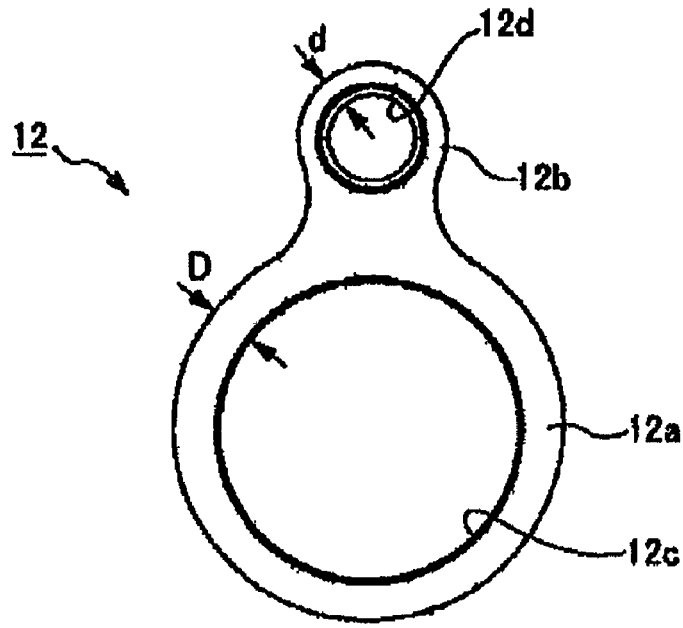
Figure 4D:
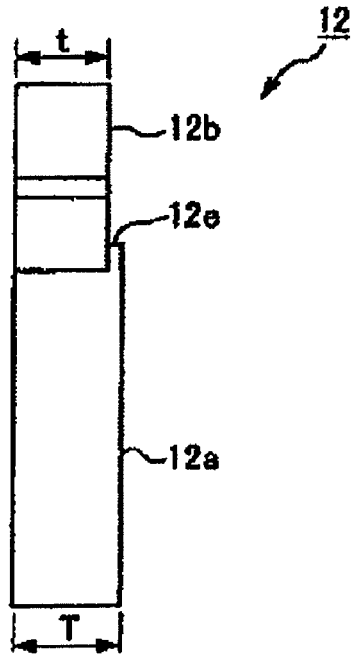

FIGS. 4A to 4D show the link arm of the valvetrain mechanism in accordance with the first embodiment of the present invention. Specifically, FIG. 4A is a perspective view, FIG. 4B is a plan view, FIG. 4C is a front view and FIG. 4D is a right-side view.

The link arm 12 includes the large end 12*a* and the small end 12*b*. As shown in FIG. 4D, the thickness "t" of the small end 12*b* is thinner than the thickness "T" of the large end 12*a*. One surface of the large end 12*a* is co-extensive with the small end 12*b* and an opposite surface thereof protrudes from the small end 12*b*, thereby forming a step portion 12*e*. In FIG. 4D, a left side surface of the large end 12*a* is co-extensive with the small end 12*b*, while a right side surface thereof protrudes from the small end 12*b* to thereby form the step portion 12*e*. Further, as shown in FIG. 1, the link arm 12 is assembled and attached such that the step portion 12*e* is on an oscillating arm side. In the large end 12*a*, a moving surface 12*c* concentric with the outer peripheral surface is formed. In the small end 12*b*, a pin inserting hole 12*d* concentric with the outer peripheral surface is formed.

Also, the thickness "d" of the small end 12*b* is thinner than the thickness "D" of the large end 12*a*.

Figure 5A:
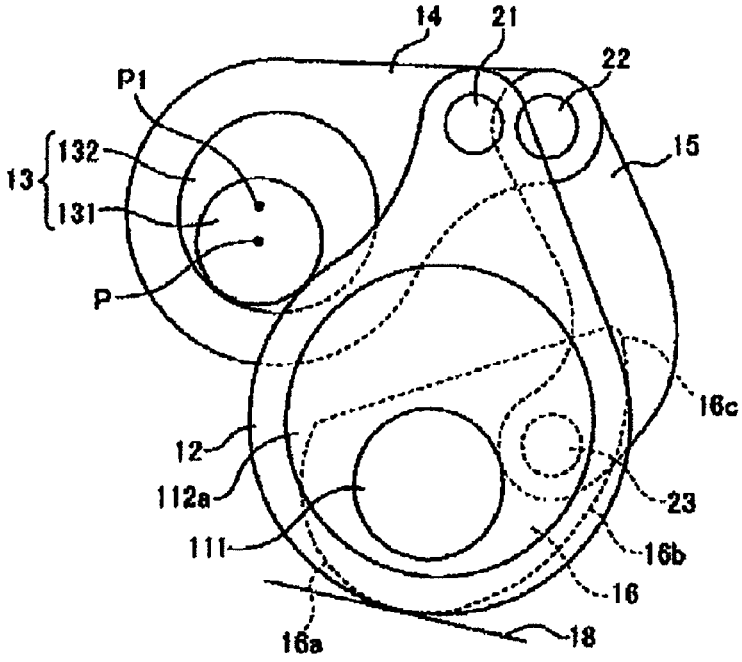
FIGS. 5A and 5B show a state of the valvetrain mechanism when the engine is operated at high speed and load.
Figure 5B:
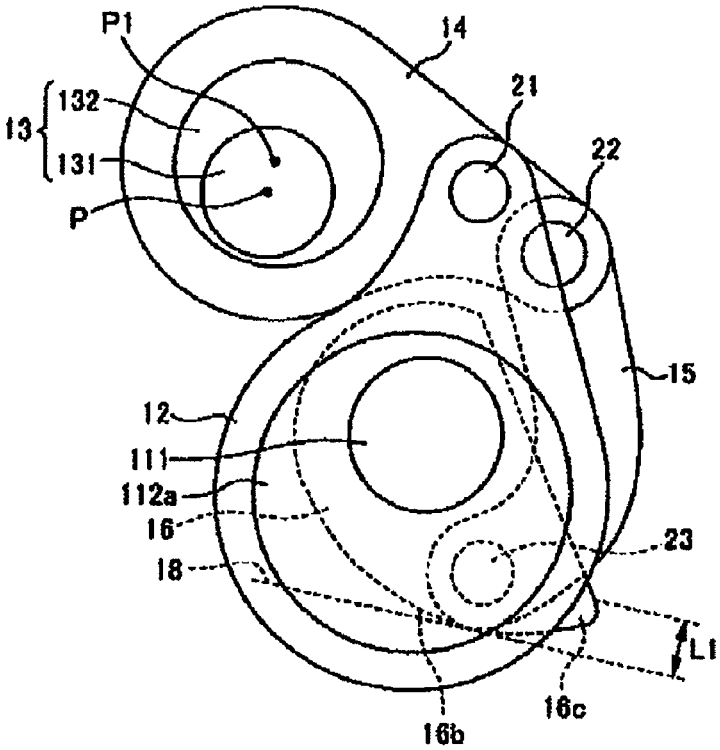

FIGS. 5A and 5B show a state of the valvetrain mechanism when the engine is operated at high speed and high load. Specifically, FIG. 5A shows a valve closed state and FIG. 5B shows a valve opened state (i.e. a maximum lift state).

When the engine is operated at high speed and high load, the valve lift control shaft 13 is rotationally driven up to a position shown in FIG. 5A. By doing so, an oscillation center P1 of the oscillating arm 14 is maintained approximately above a shaft center P of the valve lift control shaft main body 131 as shown in FIG. 5A. If the drive shaft 11 is rotationally driven in such a state, a driving force thereof is transferred from the link arm 12 to the oscillating arm 14 to the link rod 15 to the oscillating cam 16, thereby opening/closing the valve.

In the valve closed state, as shown in FIG. 5A, a base circle part 16*a* of the oscillating cam 16 contacts a valve lifter 18.

In the valve opened state, as shown in FIG. 5B, the oscillating cam 16 is greatly oscillated so that a lift portion 16*b* between the base circle part 16*a* and a cam nose 16*c* of the oscillating cam 16 contacts the valve lifter. As a result, a moving amount L1 of the valve lifter 18 is increased.

Figure 6:
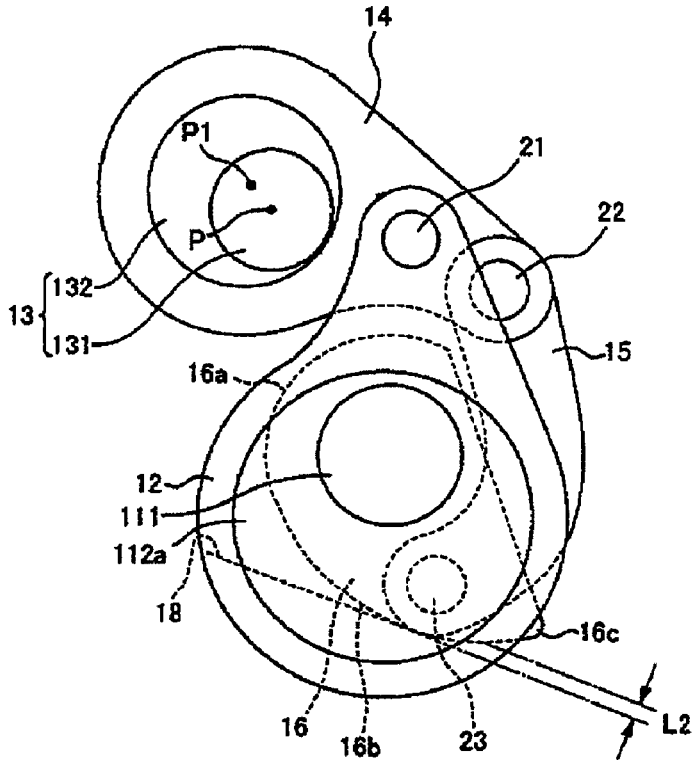
FIG. 6 shows a state of the valvetrain mechanism when the engine is operated at low speed and load.

FIG. 6 shows a state of the valvetrain mechanism when the engine is operated at low speed and low load.

When the engine is operated at low speed and low load, the valve lift control shaft 13 is rotationally driven up to a position shown in FIG. 6. By doing so, the oscillation center P1 of the oscillating arm 14 is maintained left of and above the shaft center P of the valve lift control shaft main body 131 as shown in FIG. 6. If the drive shaft 11 is rotationally driven in such a state, then a driving force thereof is transferred from the link arm 12 to the oscillating arm 14 to the link rod 15 to the oscillating cam 16, thereby opening/closing the valve. Since the oscillating arm 14 generally moves along a left side upper direction (a directed spaced from the drive shaft 11), the oscillating cam 16 presses the valve lifter 18 only until approximately a middle of the lift portion between the base circle part 16*a* and the cam nose 16*c*. As such, a lift amount L2 becomes smaller compared to the lift amount L1 shown in FIG. 5.

Figure 7:
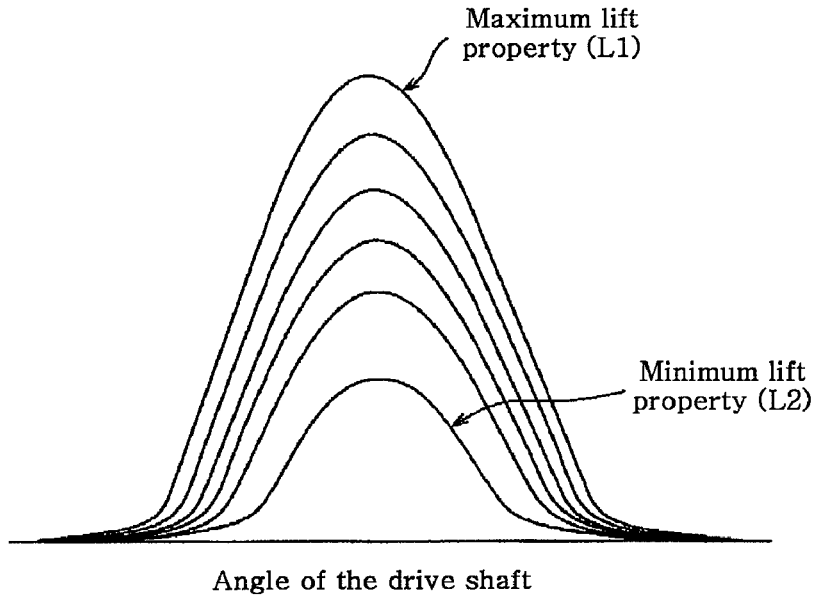
FIG. 7 shows a lift amount and an opening/closing timing of the valve when the valvetrain mechanism is adjusted.

In a low speed and low load operating condition, a cam lift property becomes smaller as compared to a high speed and high load operating condition, while a valve lift amount becomes smaller as shown in FIG. 7 as well as an operating angle, i.e., an opening section of the valve becomes smaller.

Next, effects of the present invention are explained.

As shown in FIGS. 1, 2A and 2B, in the variable valvetrain mechanism wherein the pin 21 and the pin 22 are positioned at the same side with regard to the valve lift control shaft 13, a load is exerted as described below when the valve is opened. That is, if the cam body 112*a* descends as the drive shaft 11 rotates, a position of the pin 21 is descended via the link arm 12. Accordingly, a position of the pin 22 is descended by the oscillating arm 14 so that the oscillating cam is pushed down by the link rod 15 to thereby open the valve. When the valve is opened as described above, the load is exerted to the link arm 12 along a tension direction as shown in FIG. 2A. This is so that a downward direction load is exerted to one end of the oscillating arm 14, whereas an upward direction load is exerted to another end of the oscillating arm 14. Since the loads in opposite directions are exerted to both ends of the oscillating arm 14, a moment Mx for leaning the oscillating arm 14 is generated, as shown in FIG. 2B.

Thus, as for the variable valvetrain mechanism wherein the pin 21 and the pin 22 are positioned at the same side with regard to the valve lift control shaft 13, it is necessary to suppress the moment for leaning the oscillating arm 14 as small as possible by reducing a length of a moment arm by shortening a distance between the loads as much as possible. Accordingly, it is necessary to make a distance between a center 211 of the pin 21 along a shaft direction and a center 221 of the pin 22 along a shaft direction as small as possible.

Further, according to an analysis result when the load along the tension direction is exerted to the link arm 12, it has been found that the load greatly affects the large end 12*a*as compared to the small end 12*b*. As such, the thickness "t" of the small end 12*b* is formed to be thinner than the thickness "T" of the large end 12*a*. Accordingly, a compatibility of the shape is enhanced. As a result of the above, it is possible to reduce the distance between the center 211 of the pin 21 along the shaft direction and the center 221 of the pin 22 along the shaft direction. As such, the moment for leaning the oscillating arm 14 can be suppressed (as indicated with the dashed line in FIG. 2B, if the thickness of the small end 12*b* of the link arm is the same as the large end 12*a*, then a center of the pin 21 along a shaft direction is formed so that a distance between the center 212 of the pin 21 along the shaft direction and the center 221 of the pin 22 along the shaft direction is longer). Further, the large end 12*a* is thick enough to secure the strength as well as to provide a slide moving area with regard to the drive cam 112, so that it is hard for a burning to be generated.

Second Embodiment

Figure 8A:
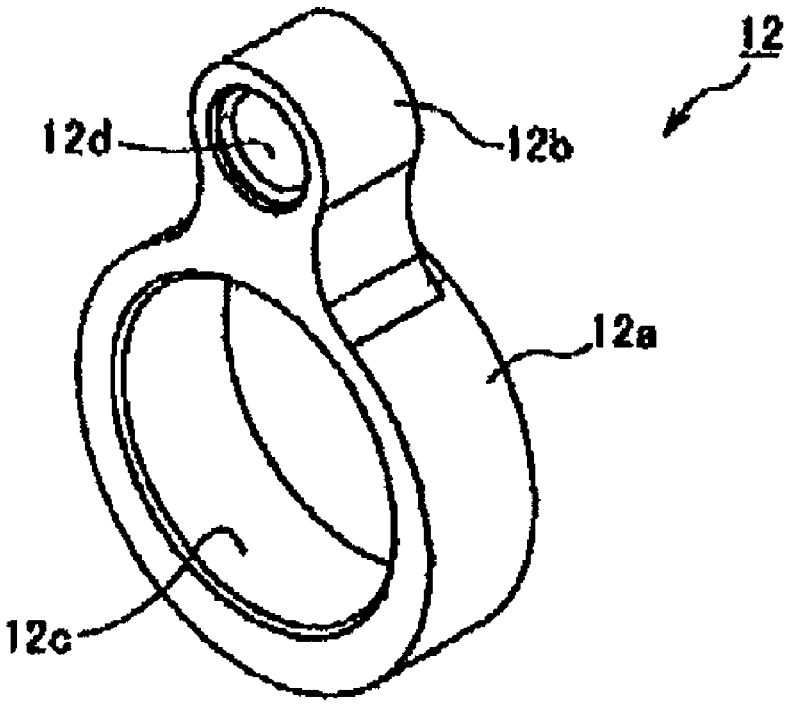
FIGS. 8A-8D show a link arm of the valvetrain mechanism of the engine in accordance with a second embodiment of the present invention.
Figure 8B:
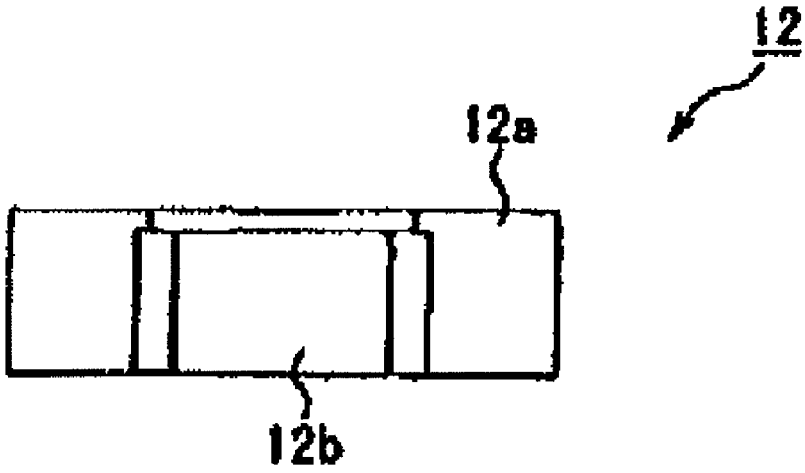
Figure 8C:
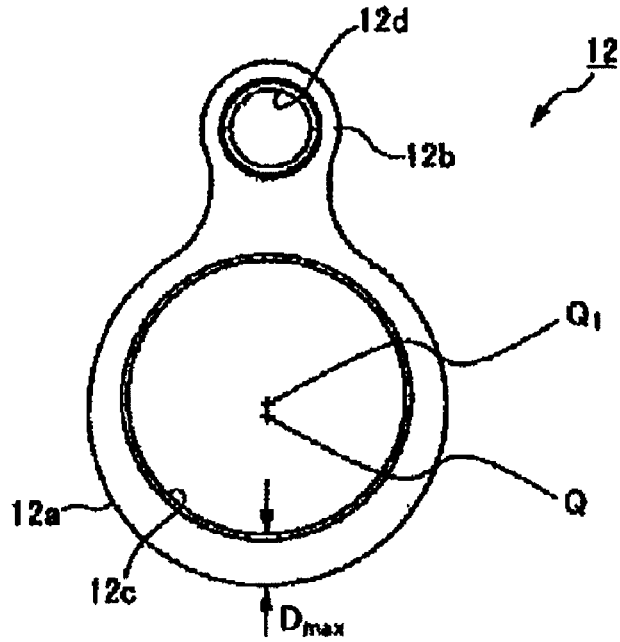
Figure 8D:
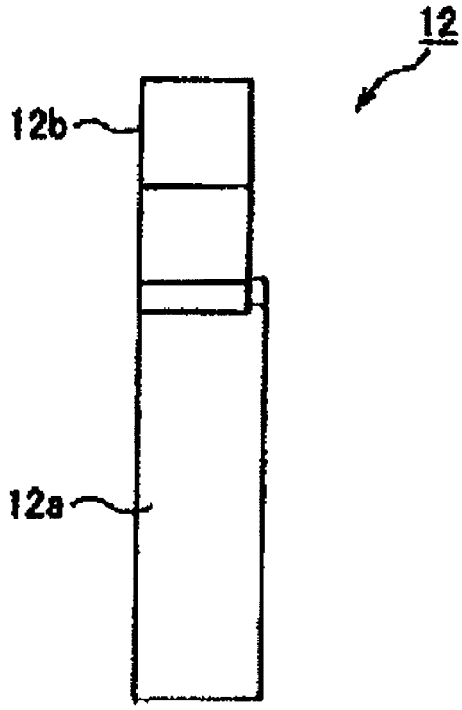

FIGS. 8A to 8D show a link arm in accordance with a second embodiment of the present invention. Specifically, FIG. 8A is a perspective view, FIG. 8B is a plan view, FIG. 8C is a front view and FIG. 8D is a right side view.

Further, the features for accomplishing the same functions as the first embodiment are denoted by the same reference numerals.

Although the slide-moving surface 12*c* is formed concentric with the outer peripheral surface of the large end 12*a* of the link arm 12 in the first embodiment, it is clear from the analysis result of the link arm 12 that the load exerted to the link arm 12 greatly affects the lower side rather than the upper side of the large end 12*a*. As such, in the present embodiment, a center Q1 of the slide-moving surface 12*c* is established above a center Q of the outer peripheral surface of the large end 12*a*. That is, thicknesses along a diametrical direction of the large end 12*a* of the link arm 12 are not constant and a thickness around a lower end is thickest as shown in FIG. 8C (Dmax).

According to the present invention, it is possible to enhance a new optimization of the shape of the link arm.

Figure 9A:
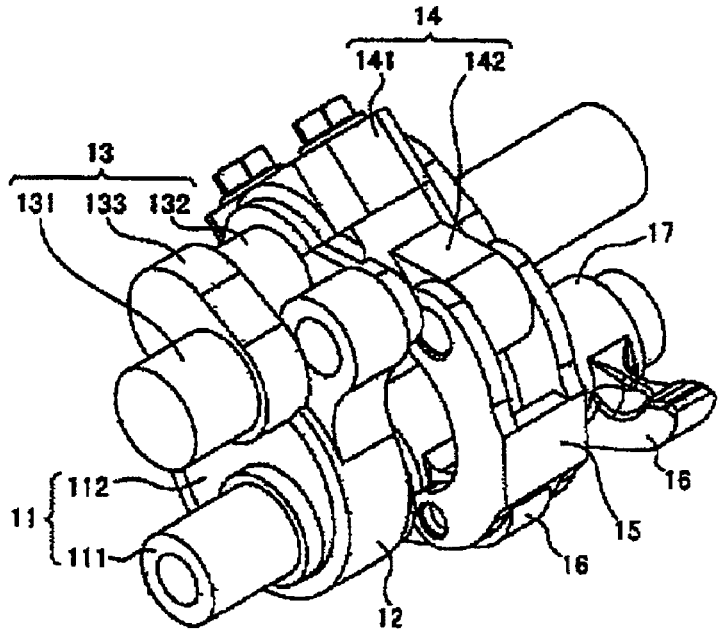
FIGS. 9A and 9B show the valvetrain mechanism of the engine in accordance with another embodiment of the present invention.
Figure 9B:
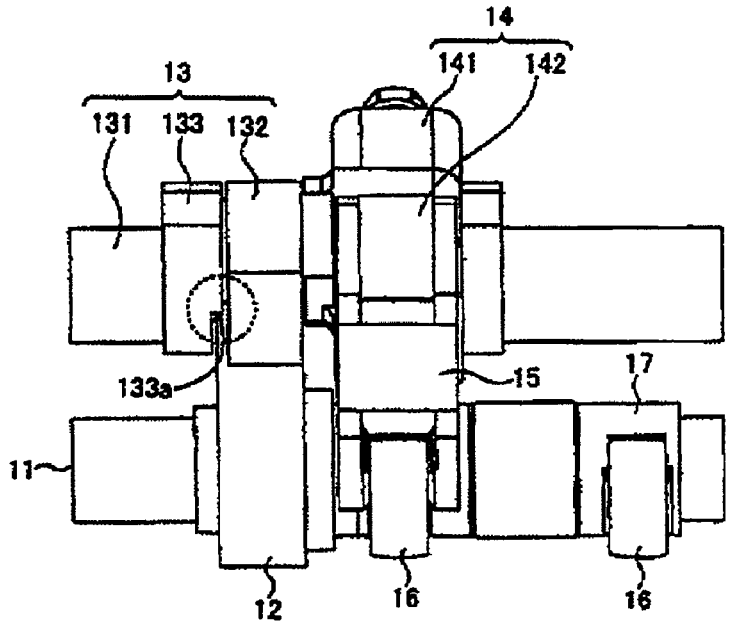
Figure 10A:
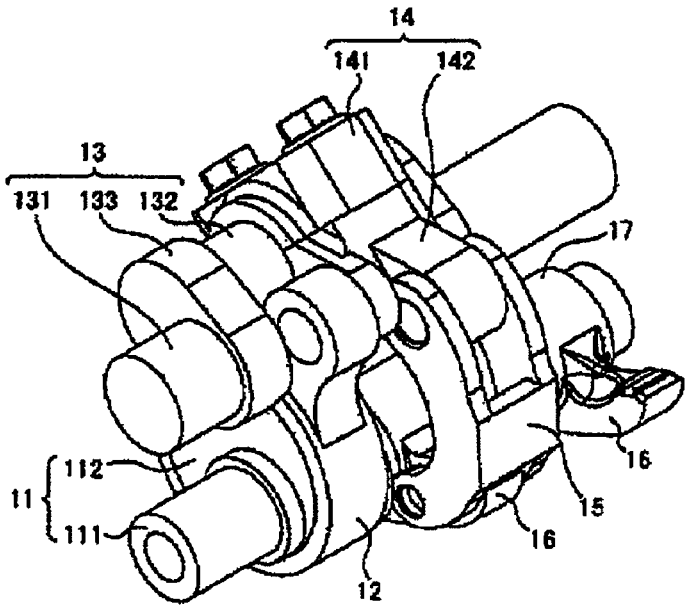
FIGS. 10A and 10B show the valvetrain mechanism of the engine in accordance with another embodiment of the present invention.
Figure 10B:
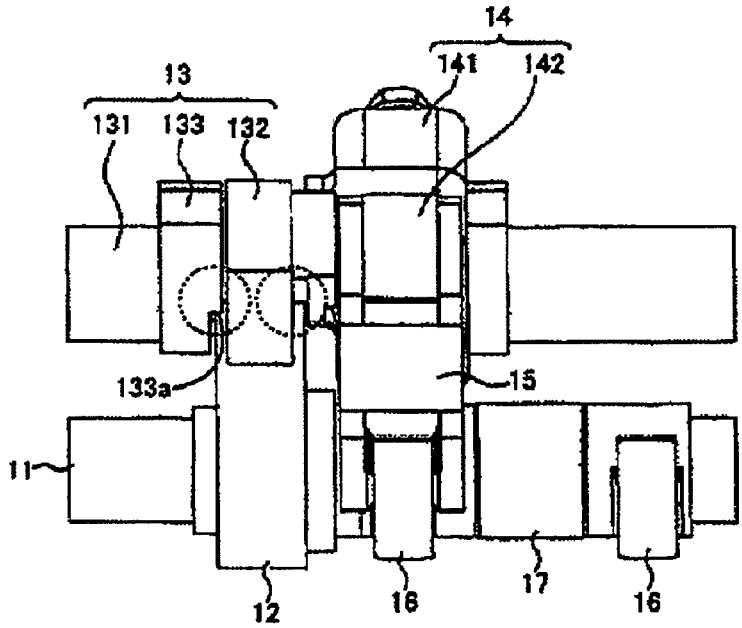

While the invention has been disclosed with reference to certain preferred embodiments, numerous modifications, alterations, and changes to the described embodiments are possible without departing from the sphere and scope of the invention, as defined in the appended claims and equivalents thereof. For example, while a protrusion direction of the large end 12*a* is toward the oscillating arm side in the first embodiment, the large end 12*a* may be protruded only toward an opposite side as shown in FIGS. 9A and 9B, or the large end 12*a* may be protruded toward both the oscillating arm side and the opposite side as shown in FIGS. 10A and 10B. Here, the valve lift control shaft in the embodiments shown in FIGS. 9A, 9B, 10A and 10B is not the eccentric cam type but rather a crankshaft type. That is, the valve lift control shaft 13 includes a main journal 131, a crank pin (eccentric portion) 132 and a web plate 133. Further, when the large end 12*a* is protruded toward the opposite side of the oscillating arm (i.e., toward the web plate), an interference with the large end 12*a* can be avoided by forming a cut portion 133*a* in the web plate 133. Also, while the step portion 12*e* is formed at the boundary of the large end 12*a* and the small end 12*b*, the thicknesses of the large end 12*a* and the small end 12*b* may be continuously changed without forming the step portion. Accordingly, it is intended that the invention not be limited to the described embodiments, but that it have the full scope defined by the language of the following claims.

The invention claimed is:

1. A valvetrain mechanism of an engine, comprising:

a drive shaft configured to rotate in synchronization with the engine;

a link arm having a large end and a small end, the drive shaft being inserted into and passed through the large end;

a valve lift control shaft disposed parallel to the drive shaft and having an eccentric portion;

an oscillating arm disposed rotatably at the eccentric portion of the valve lift control shaft and interconnected with the small end of the link arm via a first rotation support point;

a link rod interconnected with the oscillating arm via a second rotation support point positioned at a same side as the first rotation support point with respect to the valve lift control shaft; and an oscillating cam interconnected with the link rod via a third rotation support point and operated correspondingly with an operation of the drive shaft to thereby open an valve;

wherein a thickness of the small end of the link arm in a direction of the drive shaft is thinner than a thickness of the large end of the link arm in the direction of the drive shaft.

2. The valvetrain mechanism of claim 1, wherein the link arm includes a step portion resulting from a thickness difference between the large end and the small end, and wherein the step portion is protruded toward a side of the oscillating arm.

3. The valvetrain mechanism of claim 1, wherein the link arm includes a step portion resulting from a thickness difference between the large end and the small end, and wherein the step portion is protruded toward a side opposite of the oscillating arm.

4. The valvetrain mechanism of claim 1, wherein the drive shaft comprises:

a drive shaft main body and a drive cam, wherein the drive cam includes a cam body and a boss portion, and wherein the link arm moves slidably around the cam body and the boss portion is formed at the cam body; and a large hole for inserting the drive shaft main body formed in the drive cam and a small hole formed in the cam body and the boss portion; and wherein the valvetrain mechanism includes a fastening member for insertion into the small hole and fastening the drive cam to the drive shaft main body.

5. The valvetrain mechanism of claim 4, wherein the boss portion is formed with a caulking area, and wherein the caulking area is caulked after the fastening member is inserted into the small hole.

6. The valvetrain mechanism of claim 1, wherein an eccentric portion of the valve lift control shaft includes a crank pin configured to be eccentric from a main journal.

7. The valvetrain mechanism of claim 1, wherein a thickness "d" in a diametrical direction of the small end of the link arm is thinner than a thickness "D" of the large end of the link arm.

8. The valvetrain mechanism of claim 1, wherein a lower end portion of the large end of the link arm is thicker than an upper end portion of the large end of the link arm.

9. The valvetrain mechanism of claim 1, wherein the link arm includes first and second step portions resulting from a thickness difference between the large end and the small end, wherein the first step portion is protruded toward a side of the oscillating arm, and the second step portion is protruded toward a side opposite of the oscillating arm.

* * * * *